US007520075B1

(12) United States Patent
Clark

(10) Patent No.: US 7,520,075 B1
(45) Date of Patent: Apr. 21, 2009

(54) SIGN AND METHOD OF MAKING THE SAME

(76) Inventor: Thomas D. Clark, 4446 B Marin Harbor Dr., Port Clinton, OH (US) 43452

( * ) Notice: Subject to any disclaimer, the term of this patent is extended or adjusted under 35 U.S.C. 154(b) by 552 days.

(21) Appl. No.: 11/215,106

(22) Filed: Aug. 30, 2005

(51) Int. Cl.
*G09F 15/00* (2006.01)

(52) U.S. Cl. ..... 40/607.03; 40/607.06; 40/607.12; 40/610

(58) Field of Classification Search ..... 40/607.03, 40/607.05, 607.08, 607.12, 611.12, 607.06, 40/610; 248/156, 530, 533
See application file for complete search history.

(56) References Cited

U.S. PATENT DOCUMENTS

| | | | | | |
|---|---|---|---|---|---|
| 1,788,278 | A * | 1/1931 | Cortelyou | ..... | 40/607.03 |
| 2,142,547 | A * | 1/1939 | Anderson | ..... | 40/539 |
| 2,649,923 | A * | 8/1953 | Woppman | ..... | 96/147 |
| 2,990,924 | A * | 7/1961 | Plunkett | ..... | 190/11 |
| 3,058,246 | A * | 10/1962 | Schoeffier | ..... | 40/606.13 |
| 3,479,760 | A * | 11/1969 | Snyder, Jr. | ..... | 40/606.12 |
| D294,307 | S | 2/1988 | Williams | | |
| 4,765,381 | A | 8/1988 | Castle | | |
| 4,793,083 | A * | 12/1988 | McDonald | ..... | 40/606.13 |
| 4,894,937 | A | 1/1990 | Davis | | |
| 5,103,582 | A * | 4/1992 | Farmer | ..... | 40/607.12 |
| 5,267,643 | A | 12/1993 | Scribner | | |
| D371,237 | S | 7/1996 | Pfeifer | | |
| 6,148,555 | A * | 11/2000 | Beauchamp et al. | ..... | 40/612 |
| 6,170,183 | B1 * | 1/2001 | Keefe | ..... | 40/607.03 |
| 6,308,447 | B1 * | 10/2001 | Tress | ..... | 40/607.03 |
| 6,547,204 | B1 * | 4/2003 | Peck | ..... | 248/545 |
| 6,854,204 | B2 * | 2/2005 | Uden | ..... | 40/603 |
| 7,266,918 | B2 * | 9/2007 | Huenefeld | ..... | 40/611.12 |

* cited by examiner

*Primary Examiner*—Paul N Dickson
*Assistant Examiner*—Christopher E Veraa
(74) *Attorney, Agent, or Firm*—Marshall & Melhorn, LLC

(57) ABSTRACT

A sign having at least one support that is removably inserted into a core and the ground. A clamp is secured to the upper edge of the core, in part, by a connector system. The connector system also removably secures the support to the core. Sheets containing pigment containing material may be secured to the core via the clamp. A removable cover, having pigment containing material, may be located over the core.

6 Claims, 11 Drawing Sheets

SIGN AND METHOD OF MAKING THE SAME

FIELD OF THE INVENTION

The present invention relates to signs and methods of making the signs, and more particularly to yard signs.

BACKGROUND OF THE INVENTION

Everyone can appreciate that signs are an everyday part of our lives. Most, however, don't appreciate the difficulty of how a sign is assembled, how a sign is transported to its location and secured thereto and how a sign can be updated once it is in a particular location.

Most signs, particularly in the real estate field, are heavy, cumbersome signs that are difficult to assemble, transport and update. The weight and unwieldiness of the present day signs make them difficult for most people to safely handle, or load and unload from their vehicles. Often, these signs are constructed substantially of metal, thus increasing the chances for damage to one's vehicle during unloading, loading or transportation. Additionally, these signs are difficult to transport except in the largest of vehicles or vehicles with large storage areas.

Another problem with present date signs, again particularly in the real estate market, is the difficulty in updating the signs. For example, if a real estate agent would like to highlight new information regarding a particular property, or advertise an open house on a particular date, the present day signs are not easily changed.

In light of at least the disadvantages discussed above with the present day signs, it would be advantageous to have a sign that is easy to assemble, transport and update.

SUMMARY OF THE INVENTION

The present invention is directed toward a sign and a method of making the sign where the sign has at least one support having an upper and a lower portion and a substantially planar core having an upper edge and a lower edge. At least one clamp is provided for selective attachment to the upper edge of the core. At least one connector system is also provided for selectively securing the upper portion of the support to the lower edge of the core and for selectively securing the clamp to the upper edge.

The present invention is also directed toward a sign and a method of making the sign where the sign has a core having at least one interior channel extending at least partially through the core. At least one support has at least a portion which removably extends into the interior channel and another portion which is removably secured to the ground. A flexible cover, having pigment containing material thereon, is located over the core.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
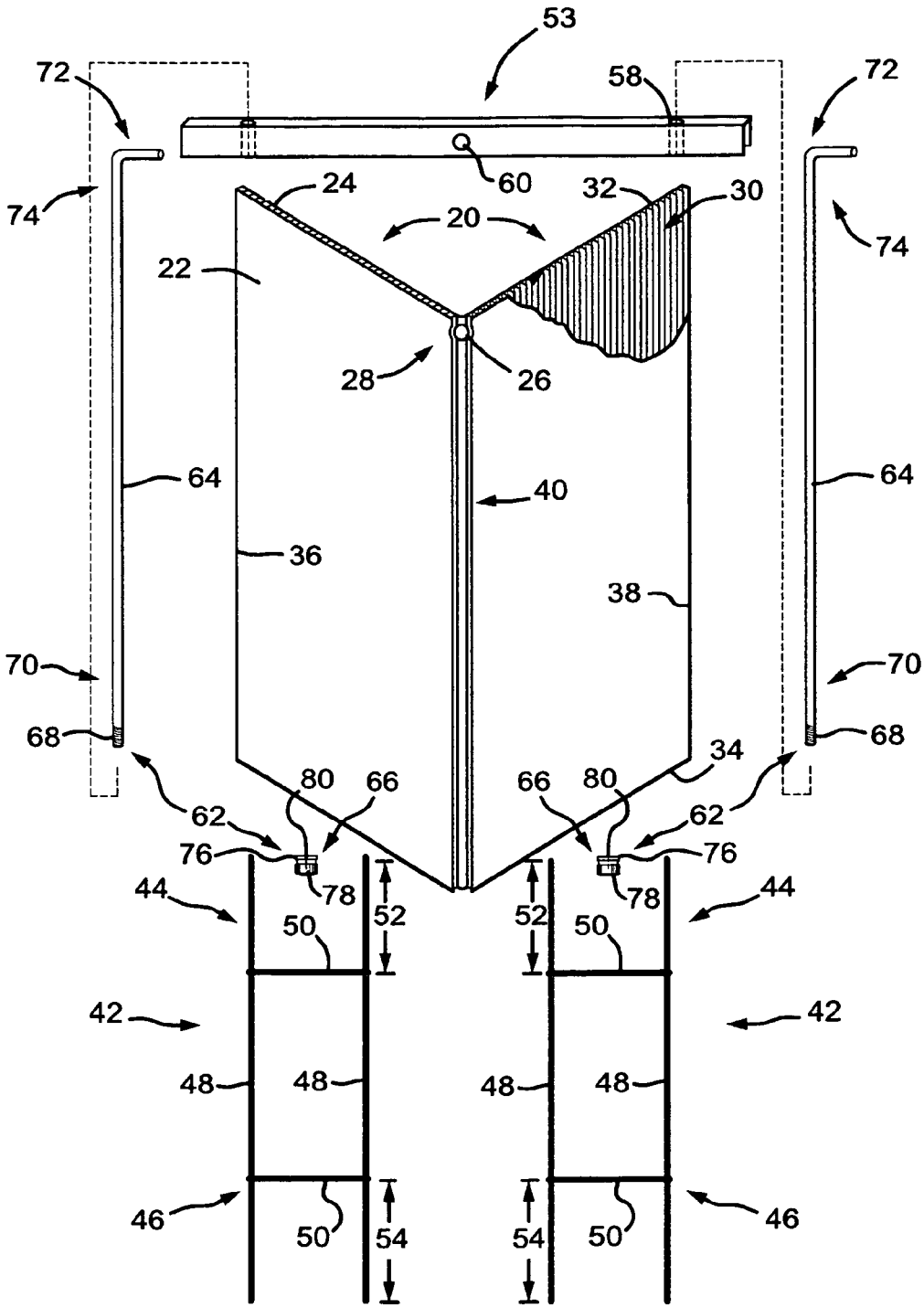
FIG. 1 is a schematic, exploded view of components for a preferred embodiment of the present invention.

Referring now to FIG. 1, a core 20 is depicted. Preferably, the core 20 is an extruded, twin wall structure constructed of a polypropylene copolymer, although other materials known to those skilled in the art may be used. A polypropylene copolymer or similar material is desirable since it has high impact performance, it is capable of withstanding most ambient temperatures in the world, it is chemically inert, and most solvents and water have no effect on it. Those skilled in the art also know that the material can be produced in a variety of different colors and additives can be included to make the material resistant to ultra-violet light, static resistant and resistant to flame.

The core 20 depicted in FIG. 1 is rectangular in shape, however, the core 20 may be any shape or size, including, but not limited to, square, triangular, circular, oval or any multi-sided geometric shape or combination of geometric shapes.

One of the walls will be designated a first wall 22 and the other wall will be designated a second wall 24 for purposes of clarity and specificity. The first wall 22 and the second wall 24 are preferably located anywhere from approximately 2 millimeters to approximately 14 millimeters away from one another, however, larger and smaller dimensions are within the scope of the present invention.

Preferably, at least one aperture, hereinafter called the core aperture 26, extends through the first wall 22 and through the second wall 24. The core aperture 26 may be located at approximately the midpoint 28 of the core 20, however, it may be offset from the midpoint 28 by a pre-determined distance.

Between the first wall 22 and the second wall 24 is a plurality of channels 30. Preferably, the core 20 is oriented so that the channels 30 extend vertically and run from an upper edge 32 of the core 20 to a lower edge 34 of the core 20. In the preferred embodiment, the channels 30 extend from a first side edge 36 to a second side edge 38 of the core 20. Alternatively, the channels 30 may be only in selected areas of the core 20.

In the preferred embodiment depicted in the figures, each of the channels 30 extends without interruption from the upper edge 32 to the lower edge 34 of the core 20. In another embodiment (not shown), at least two of the channels 30 extend without interruption from the upper edge 32 to the lower edge 34 of the core 20. In that embodiment, the other channels 30 extend up from the lower edge 34 without interruption approximately half way between the upper edge 32 and the lower edge 34 of the core 20.

Preferably, at approximately the midpoint 28 of the core 20, one of the walls 22 or 24 is cut from the upper edge 32 to the lower edge 34. In the embodiment depicted in FIG. 1, the first wall 22 is shown as having a cut 40, however, it should be appreciated that either the first wall 22 or the second wall 24 can have the cut 40. The second wall 24, adjacent the cut 40 in the first wall 22, is preferably left intact.

Without the cut 40, the first wall 22, the second wall 24 and the plurality of channels 30 between them form a relatively rigid structure that is not susceptible to bending or tearing. The rigidity is also dependent upon the thickness of the walls 22, 24 themselves. The cut in the first wall 22, however, intentionally reduces the rigidity of the structure. The second wall 24, opposite the cut 40 in the first wall 22, functions as a hinge 41 to allow the core 20 to be completely folded in half. Folding the core 20 in half facilitates transport of the core 20.

At least one support 42, having an upper portion 44 and a lower portion 46, is also provided. Preferably, two supports 42 are used, each having an upper portion 44 and a lower portion 46, where the upper portion 44 of each support 42 is selectively attached to the core 20. The support 42 may be such as described and depicted in U.S. Pat. No. 4,894,937, which is incorporated by reference in its entirety herein.

The supports 42 are preferably comprised of at least two vertical members 48 and at least two horizontal members 50. One horizontal member 50 is attached to the upper portion 44 of each support 42 and one horizontal member 50 is attached to the lower portion 46 of each support 42. The horizontal and vertical members 48, 50 are preferably constructed of metal so that they can be welded together. Preferably, both horizontal members 50 for a particular support 42 are welded to the same side of the vertical members 48, although it is within the scope of the invention to attach one horizontal member 50 to one side of the vertical members 48 and another horizontal member 50 to the other side of the vertical members 48.

The horizontal members 50 on the upper portion 44 of each support 42 are located a pre-determined distance 52 from the tops of each vertical member 48. The horizontal members 50 on the lower portion 46 of each support 42 are also located a pre-determined distance 54 from the bottoms of each vertical member 48.

The exact location of the horizontal members 50 along the vertical members 48 is dependent upon the size of the core 20, the weight of the core 20 and the height of the sign. Preferably, the horizontal members 50 located on the upper portion 44 of the support 42 are located to allow the vertical members 48 to be inserted into the core 20 a sufficient distance so that the core 20 will not easily fall off of the support 42. Similarly, the horizontal members 50 located on the lower portion 46 of the support 42 are located to allow the vertical members 48 to be inserted into the ground a sufficient distance so that the supports 42 are not easily removed and so that the core 20 is adequately secured in the ground.

Those skilled in the art will appreciate that the horizontal and vertical members 48, 50 can be constructed out of strong and rigid materials other than metal, such as wood or plastic. And, in such a case, other means for joining the members 48, 50 such as mechanical fasteners, adhesives and/or interlocking the members 48, 50 with one another is within the scope of the present invention.

The vertical members 48 of each support 42 preferably have a complementary shape and dimension to the channels 30 of the core 20. The vertical members 48 of each support 42 also are spaced apart from one another a pre-determined distance for easy alignment with the channels 30 within the core 20.

FIG. 1 also depicts a clamp 53 that is selectively attached along the upper edge 32 of the core 20. Preferably, the clamp 53 is a C-shaped clamp that extends from the first wall 22, across the upper edge 32 of the core 20 to the second wall 24. Those skilled in the art will appreciate that the clamp 53 can also be comprised of multiple pieces that can be located along the upper edge 32 to extend from the first wall 22 to the second wall 24. Regardless of the number of pieces of the clamp 53, it is designed to frictionally engage the first wall 22 and the second wall 24 of the core 20.

The clamp 53 has at least one aperture extending through it, however, in the preferred embodiment depicted in the figures, the clamp 53 has two apertures, hereinafter designated the first clamp aperture 56 and the second clamp aperture 58. Preferably, the first clamp aperture 56 and the second clamp aperture 58 are both located in the portion of the clamp 53 that is parallel with the upper edge 32 of the core 20 when the clamp 53 is installed on the core 20. Additionally, the first and second clamp apertures 56, 58 are preferably located in alignment with at least two of the plurality of channels 30 in the core 20 when the clamp 53 is located on the core 20.

The clamp 53 is preferably constructed of a semi-flexible plastic, however, other flexible, similar materials known to those skilled in the art are also within the scope of the present invention.

A third clamp aperture 60 is also located in the clamp 53. Preferably, the third clamp aperture 60 is located in approximately the middle of the clamp 53, as shown in FIG. 1. The third clamp aperture 60 is located through the portions of the clamp 53 that are parallel to the first wall 22 and the second wall 24 when the clamp 53 is installed on the core 20.

A connector 62 is also depicted in FIG. 1. The connector 62 comprises at least one rod 64 and at least one locking device 66. Preferably, two rods 64 are used where each rod 64 has a first set of threads 68 on a first end 70 and a curvilinear portion 72 on a second end 74. The rods 64 are constructed of metal, however, other rods 64 constructed of other suitable materials, such as wood and plastic, may also be used. The rods 64 have a complementary shape to the first clamp aperture 56 and the second clamp aperture 58 and they have a complementary shape to the channels 30 in the core 20.

The locking device 66 is preferably a washer 76 and a nut 78 having a complementary set of threads 80 to the first set of threads 68. The washer 76 may be sized so that when the horizontal member 50 on the upper portion 44 of the support 42 is adjacent the lower edge 34 of the core 20, the washer 76 contacts the horizontal member 50 to secure it in place as the nut 78 is tightened.

Figure 2:
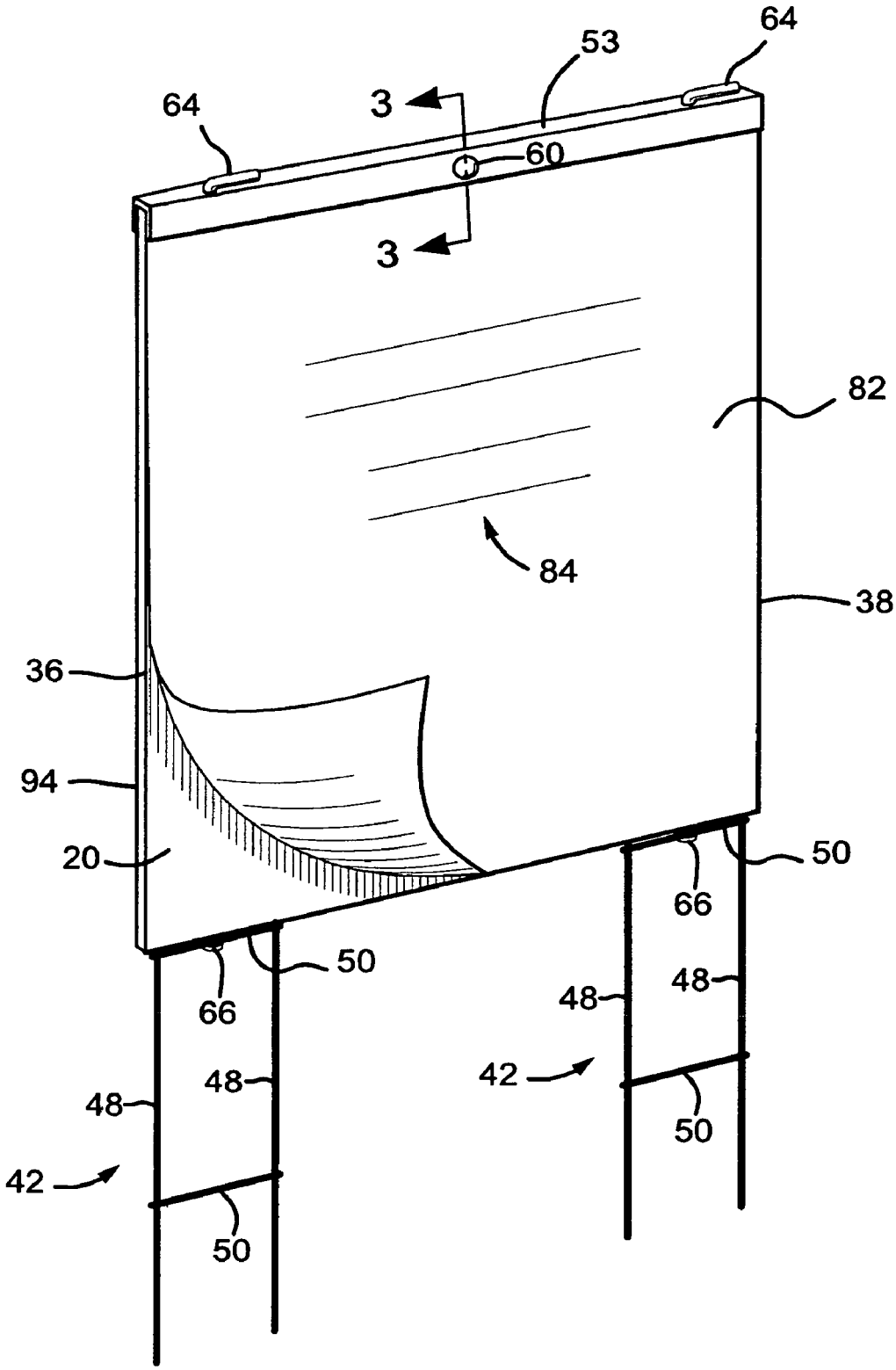
FIG. 2 is a schematic, assembled view of one embodiment of the present invention.

Referring now to FIG. 2, the present invention also comprises at least one sheet of material, hereinafter the first sheet 82, having pigment containing material 84 thereon. The pigment containing material 84 may be used to form a plurality of alphanumeric characters in the form of words, images or designs on the sheet 82. By way of example only, the pigment containing material 84 may be used to form a real estate sign containing information regarding a particular property.

Figure 3:
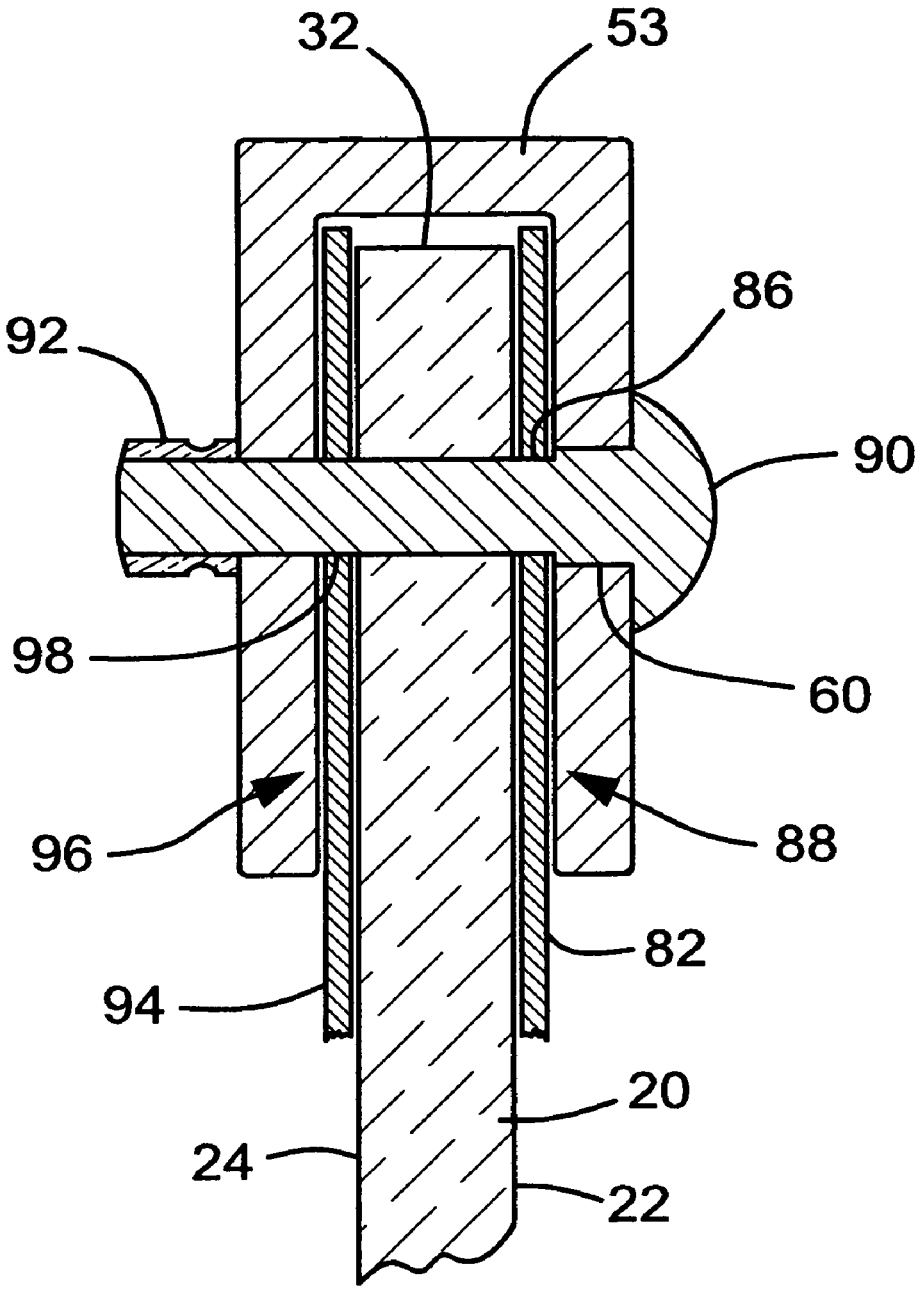
FIG. 3 is a schematic side view of a portion of a preferred embodiment of the invention taken along line 3-3 of FIG. 2.

Preferably, the first sheet 82 is flexible and capable of being repeatedly rolled and unrolled for transport, storage and display. The first sheet 82 has a complementary shape to the core 20. As seen in FIG. 3, the first sheet 82 preferably has an aperture 86 through an upper portion 88 thereof.

The upper portion 88 of the first sheet 82 is located between the core 20 and the clamp 53. Preferably, the aperture 86 in the first sheet 82 is aligned with the clamp aperture 60 and the core aperture 26. A mechanical fastener, such as a bolt 90, is located through the first sheet aperture 86, the clamp aperture 56 and the core aperture 26. A nut 92 is attached to a portion of the bolt 90 that extends through core 20. The nut 92 and bolt 90 secure the first sheet 82 to the core 20.

A second sheet 94 of identical construction, with or without pigment containing material 84, may be similarly attached to the core 20 adjacent the second wall 24, as shown in FIG. 3. An upper portion 96 of the second sheet 94 is located between the core 20 and the clamp 53. The second sheet 94 has an aperture 98 for receiving the bolt 90.

One or both of the sheets 82, 94 may be also secured to the core 20 with a plurality of hook and loop fastener strips (not shown). Either the hook portions or the loop portions of the strips may be secured anywhere on the first and/or second walls 22, 24 of the core 20. The complementary portions of the strips are then located on the first and/or second sheets 82, 94 so that the portions contact one another when the sheet(s) 82, 84 is/are located adjacent the core 20. Those skilled in the art will appreciate that other means to temporarily secure the sheets 82, 94 to the core 20, other than hook and loop fasteners, are well within the scope of the present invention.

Figure 4:
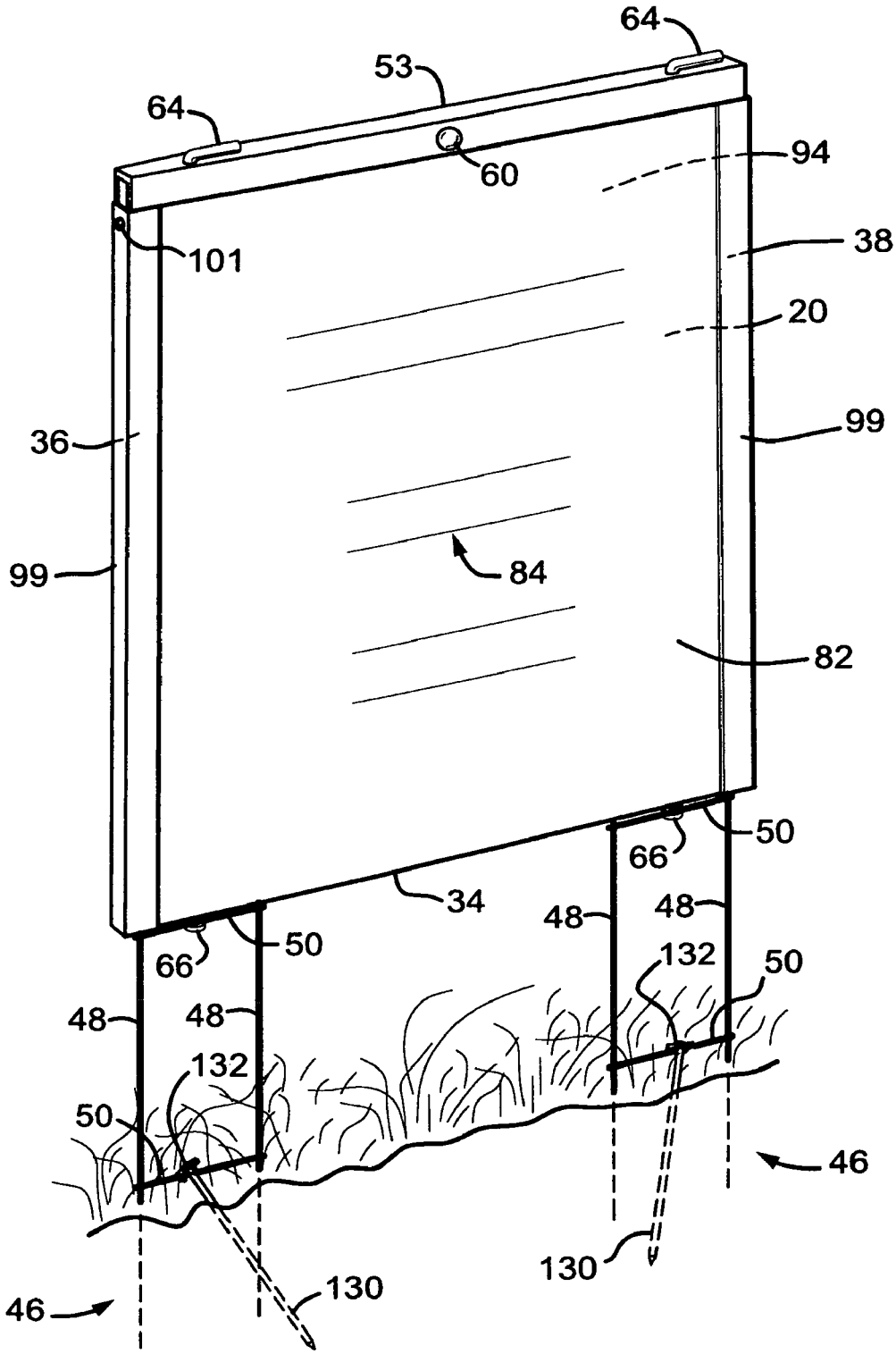
FIG. 4 is a schematic, perspective view of another embodiment of the present invention.

Side clamps 99, as shown in FIG. 4, may be removably secured to the first side edge 36 of the core 20 and the second side edge 38 of the core 20. Preferably, the side clamps 99 are C-shaped and constructed of a semi-flexible plastic material. The first sheet 82 and the second sheet 94 may be located between each side clamp 99 and the first and second walls 22, 24 of the core 20, respectively. The side clamp 99 may be used with, or without, the hook and loop fasteners to removably secure the first and/or second sheets 82, 94 to the core 20.

A mechanical fastener, such as a screw 101, may be located through the side clamps 99 and into the core 20. Additionally, in an embodiment not depicted in the figures, a portion of the side clamps 99 near the upper edge 32 of the core 20 may be located under the clamp 53 to give the clamps 53, 99 a uniform appearance.

Figure 5:
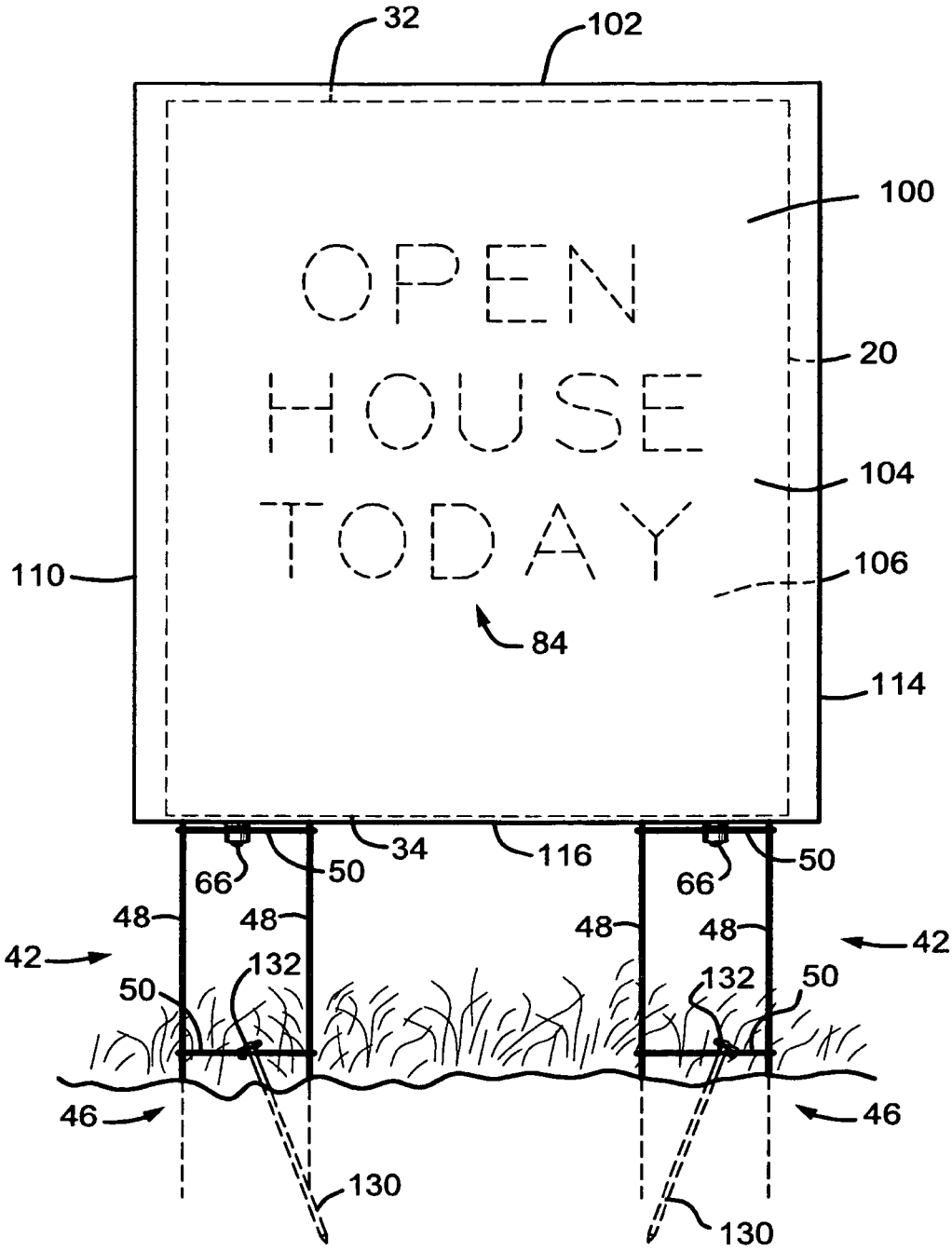
FIG. 5 is a schematic, perspective view of another embodiment of the present invention.

Another embodiment of the present invention includes a cover 100 sized to fit over at least the core 20, as shown in FIG. 5. Preferably, the cover 100 is also sized to fit over any clamps and any mechanical fasteners. The cover 100 can extend downwardly from the upper edge 32 of the core 20 any distance, however, it is preferred that the cover 100 extends at least to the lower edge 34 of the core 20, if not slightly beyond the lower edge 34.

Preferably, the cover 100 is constructed of a weather-proof, flexible material, such as plastic, that may be of any color, or it may be clear, or it may have a combination of clear portions and colored portions. In the preferred embodiment, the cover 100 is constructed of plastic having threads or fibers integrally woven therewith to provide strength and tear resistance. It is also preferred that the cover material is capable of receiving pigment containing material 84 so that many different designs, alphanumeric symbols and/or images may be included thereon.

The cover 100 is preferably constructed of a rectangular sheet of plastic that is folded so the edges having the shortest length of the rectangle are located adjacent one another. This step creates a closed top 102, a front 104 and a back 106 of the cover 100, as shown in FIG. 6.

A portion of a first free edge 108 on the first side 110 is folded onto itself. The folded first free edge 108 is kept in the folded condition with adhesive and/or stitching. A portion of a second free edge 112 on the first side 110 is then folded around the folded first free edge 108 and glued and/or stitched in place to close the free edges 108, 112 of the cover 100. A similar procedure is used to close a second side 114 of the cover 100. The bottom edge 116 of the cover 100 is left open.

Figure 6:
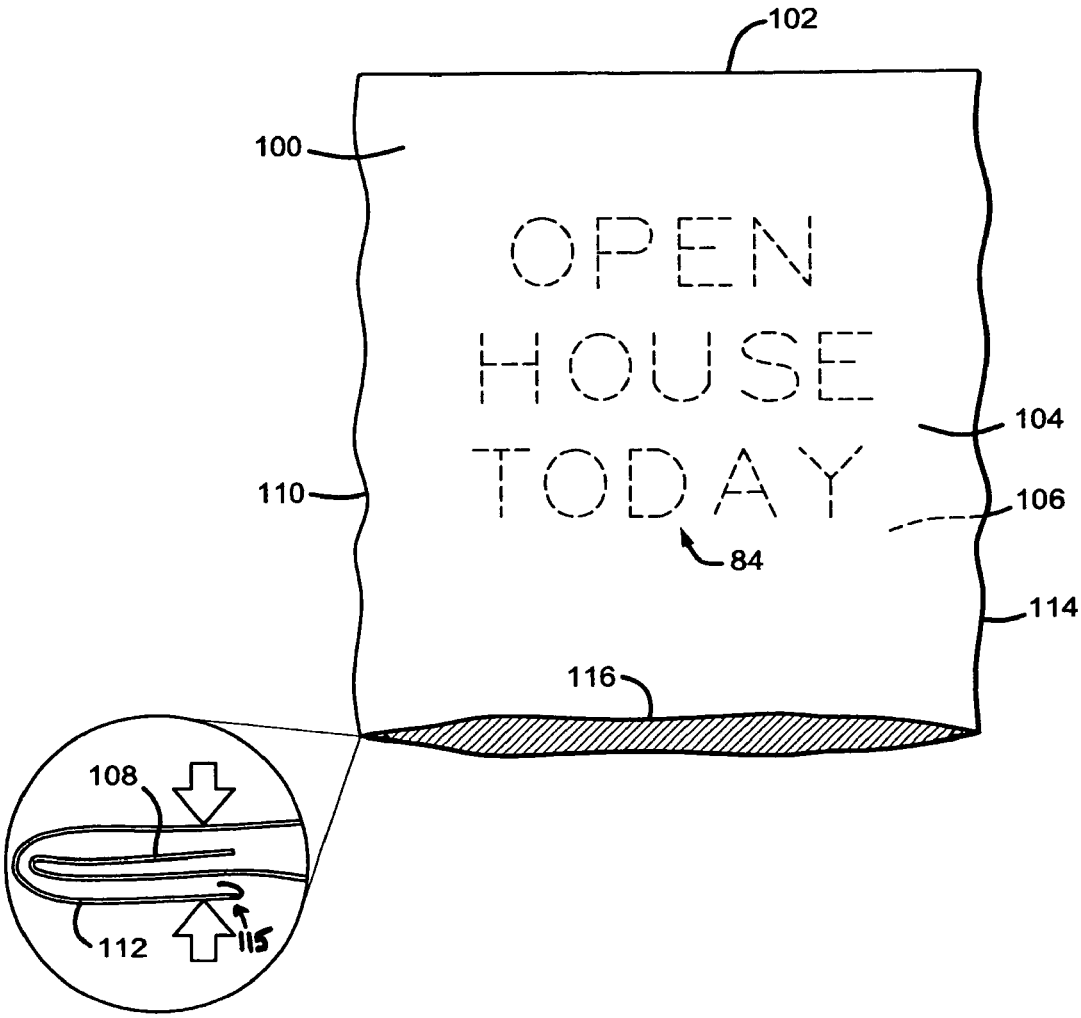
FIG. 6 is a schematic view of a component of the present invention.

As seen in FIG. 6, it is preferred that an end portion 115 of sheet 112 is folded over again onto itself and secured thereto to prevent fraying of the end portion 115.

Those skilled in the art will appreciate that other means of closing the free edges 108, 112 of the cover 100 are well within the scope of the present invention. The other means include, without limitation, selectively closing portions of the free edges 108, 112 and allowing other portions of the free edges 108, 112 to remain open. This, as well as other means of closing the edges 108, 112, may be accomplished through adhesives, hook and loop fasteners, weatherproof tape, heat seals, mechanical fasteners, and/or stitching. It can also be readily appreciated that covers 100 conforming to other shapes of cores 20, other than rectangular, are within the scope of the present invention.

Figure 7:
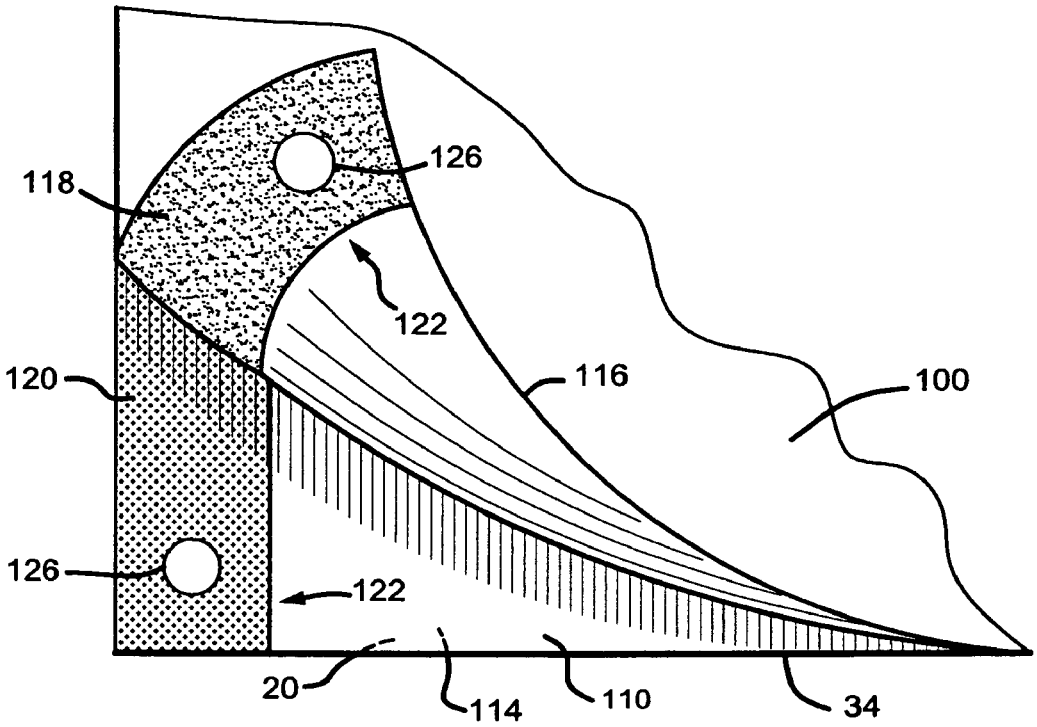
FIG. 7 is a partial schematic view of a component of the present invention.

One or more strips of hook fasteners 118 and loop fasteners 120 may be located along the bottom inside edge 122 of the cover 100, particularly adjacent the sides, as shown in FIG. 7. The hook fasteners 118 or the loop fasteners 120 are located on the front of the cover 100 and the complementary portion is located on the back 106 of the cover 100. The hook and loop fasteners 118, 120 permit the bottom edge 116 of the cover 100 adjacent the first side 110 and the second side 114 to be selectively opened and closed under the lower edge 34 of the core 20. In the closed orientation, the hook and loop fasteners 118, 120 help secure the cover 100 to the core 20.

Figure 8:
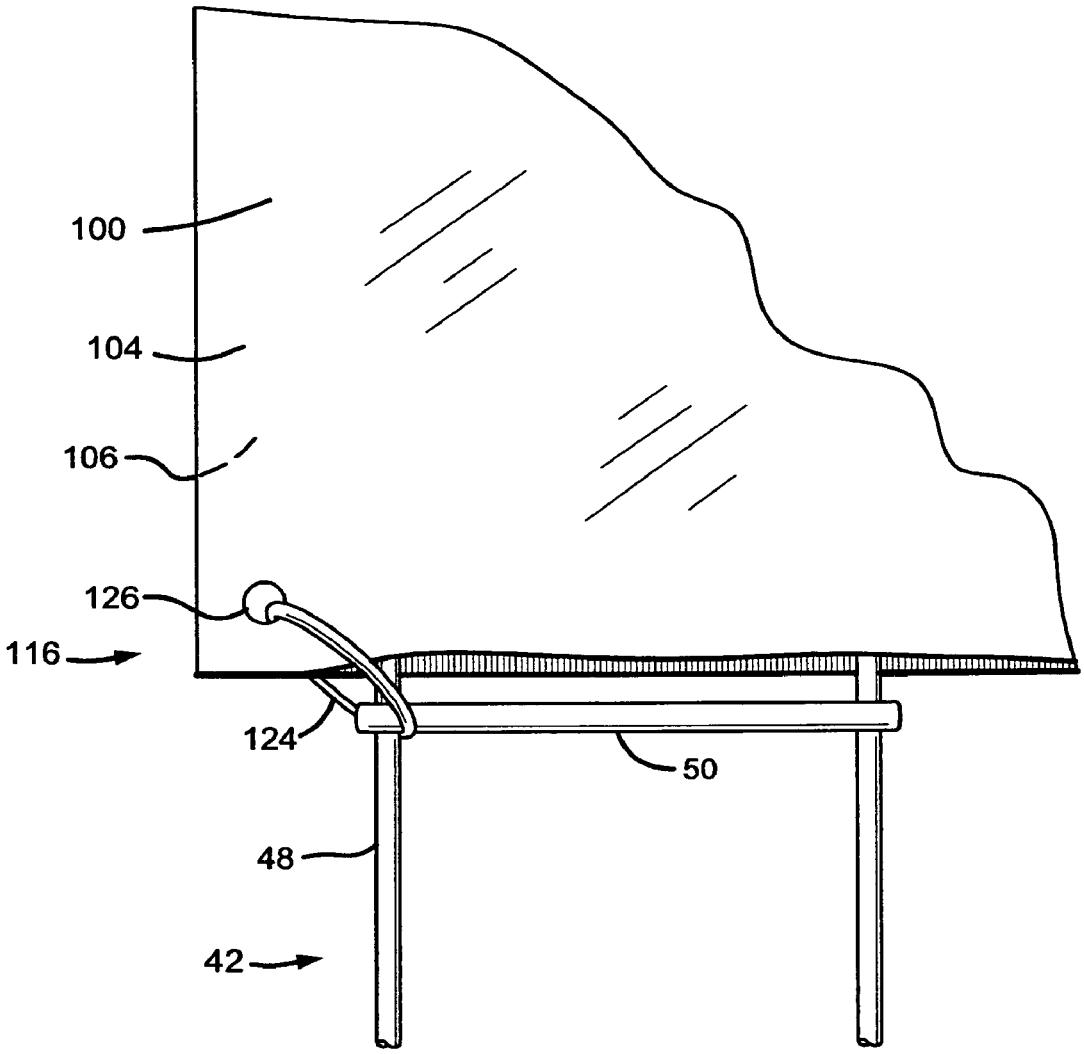
FIG. 8 is a partial schematic view of a component of the present invention.

As depicted in FIG. 8, at least one locking strip 124 may be located through an aperture 126 in the bottom edge 116 of the front 104 and back 106 of the cover 100. The aperture 126 may be located in just one corner of the cover 100 or an aperture 126 may be located in both corners of the cover 100. If the above-described hook and loop fasteners 118, 120 are located at the bottom edge 116 of the cover 100, the aperture 126 preferably extends through the fastener strips 118, 120, as shown in FIG. 7. The locking strip 124 is preferably constructed of a weather resistant, flexible material such as plastic. The locking strip 124 is of sufficient length and flexibility to extend through the aperture 126 and wrap around one of the vertical members 48 of the support 42.

Figure 9:
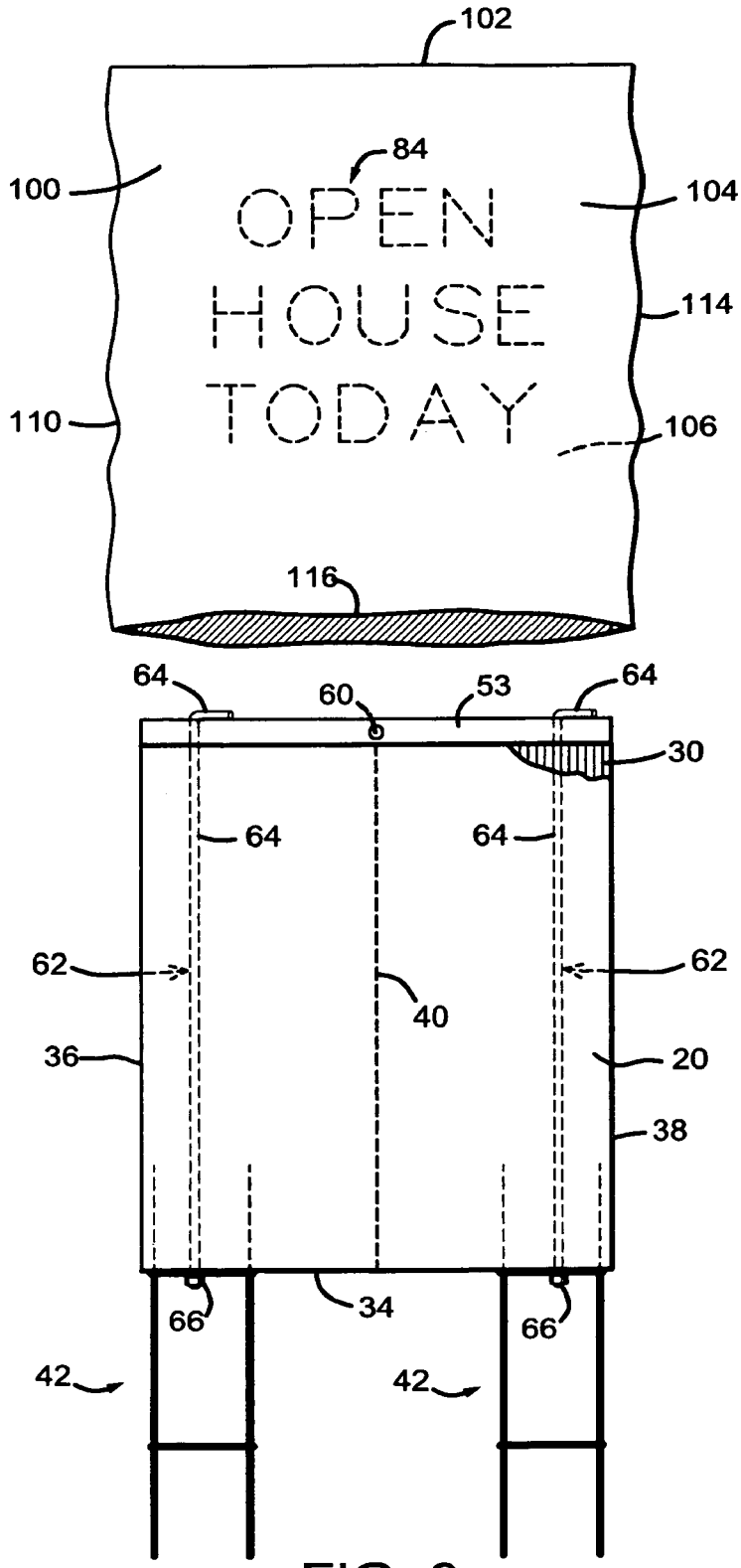
FIG. 9 is a schematic view of a method of assembling one embodiment of the present invention.
Figure 10:
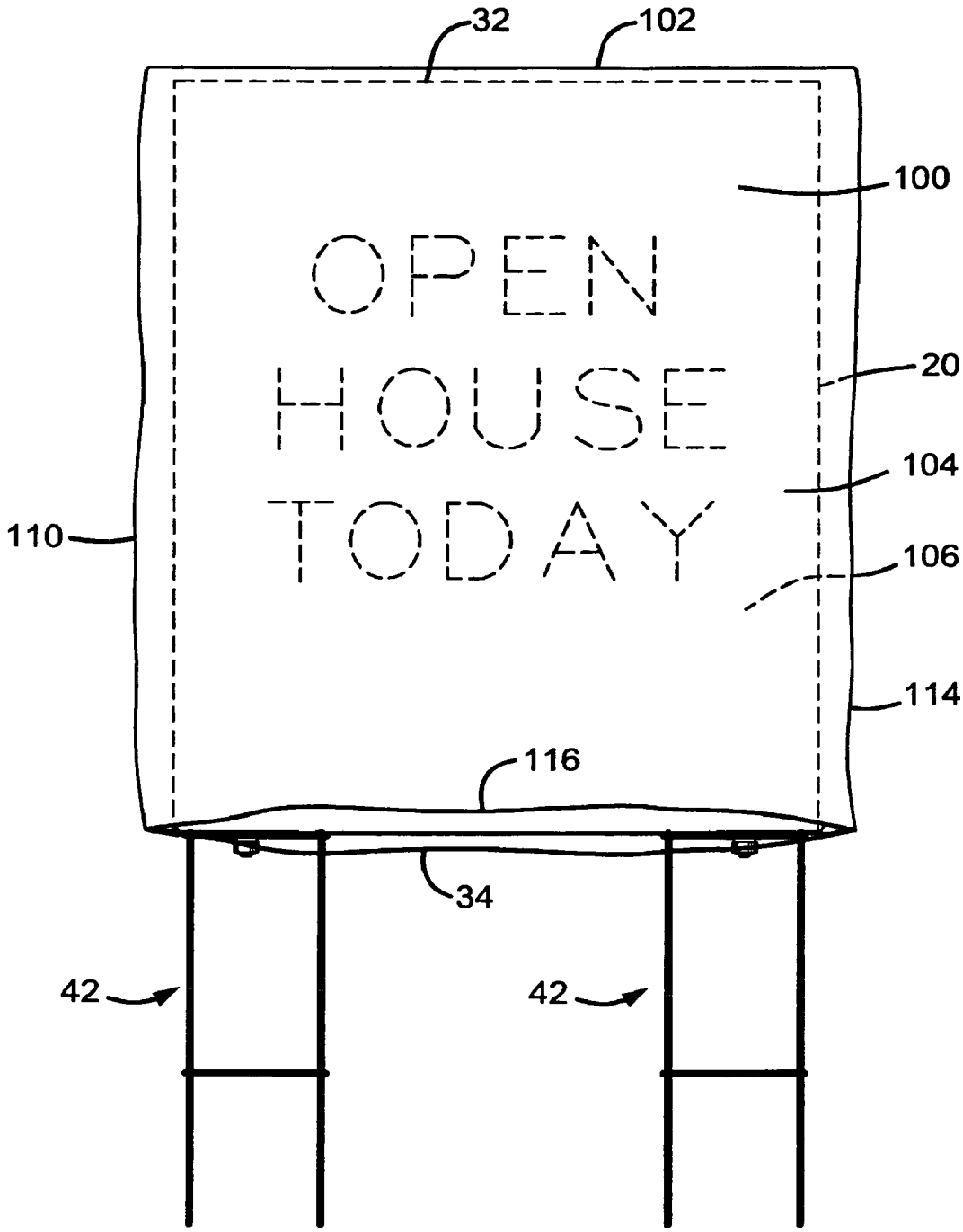
FIG. 10 is a schematic view of a method of assembling one embodiment of the present invention.

The present invention also comprises a sign utilizing the core 20, the at least one support 42 and the cover 100 which have been described above. FIGS. 9 and 10 depict a preferred embodiment of this sign wherein identical reference numbers used in FIGS. 1-8 have been used again to depict identical components. In this embodiment, the sign need not utilize the side clamps 99, the sheets 82, 94, or the bolt 90. Preferably, the clamp 53 is used and the connector system 62 is used. The cover 100 extends over the core 20 and the cover 100 can be secured thereto as described above.

The present invention also comprises a method of making the sign. The method comprises providing the core 20 described above. The core 20, in addition to all of the other parts described above, may be provided to an end-user via a kit by any known delivery means. By way of example only, the kit may be located in a box and shipped from the manufacturer to the customer via regular or express mail using any of the known delivery companies. Regardless of the embodiment selected to be shipped, a core 20 will be included in the kit. The core 20 is preferably folded to reduce the size of the box needed for shipping.

Figure 11:
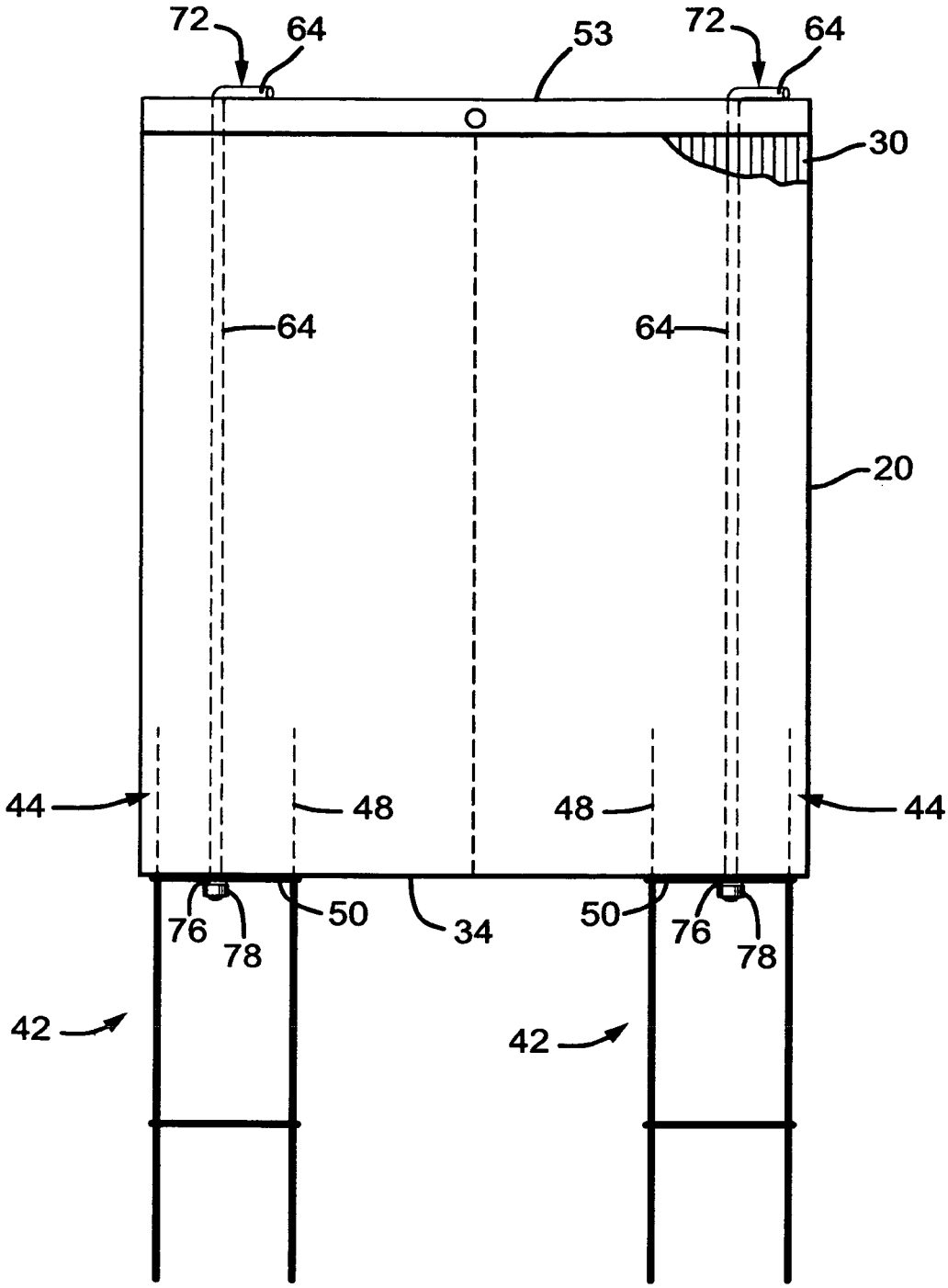
FIG. 11 is a schematic view of another embodiment of the present invention.

Upon receipt of the kit, the customer removes the core 20, unfolds it, and attaches the clamp 53 along the upper edge 32 of the core 20 to secure the core in a substantially planar orientation, as shown in FIG. 11. The vertical members 48 of the upper portions 44 of the supports 42 are inserted into the interior channels 30 of the core 20.

The rods 64 are preferably inserted into any of the unused interior channels 30 in the upper edge 32 of the core 20. The rods 64 are then pushed all the way through the interior channels 30 until they extend beyond the lower edge 34 of the core 20. The curvilinear portions 72 of the rods 64 are aligned with the clamp 53 so that both of the curvilinear portions 72 are substantially engaged with the clamp 53.

A washer 76 and a nut 78 are located on the portion of each rod 64 that extends beyond the lower edge 34 of the core 20. The nut 78 is advanced to bring the washer 76 into contact with the horizontal support member 50. Continued advancement of the nut 78 secures the support 42 to the core 20 and also secures the clamp 53 to the core 20 via the curvilinear portion 72 of the rod 64.

As shown in FIG. 2, the first sheet 82 and second sheet 94, if any, can be manually located between the core 20 and the clamp 53. Additionally, either the hook portion or the loop portion of hook and loop fastener strips (not shown) can be located on one or both of the sheets 82, 84 and the complementary portion can be located on the core 20. The hook and loop portions can be selectively engaged and disengaged to removably secure the sheets 82, 84 to the core 20. Furthermore, the side clamps 99, depicted in FIG. 4, may be located over the side edges 36, 38 of the core 20 and the first sheet 82 and second sheet 94, if any.

Referring to FIG. 3, the bolt 90 may be located through the apertures 86, 98 in the sheets 82, 84, or through an aperture in just one of the sheets, as the case may be. Additionally, the bolt 90 is located through the core aperture 26 and the third clamp aperture 60. The nut 92 is located on the end of the bolt 90 to secure the sheet, or sheets 82, 84, in place.

The sign is then taken to the spot where it is to be located, such as in grass or dirt, as shown in FIG. 4. The sign is preferably held with both hands and one foot is placed on one of the horizontal members 50 on the lower portion 46 of the support 42. A downward force is applied to the horizontal member 50 by the foot to drive the lower portion 46 of the support 42 at least partially into the ground. If there is a second support 42, a similar procedure is used to locate the lower portion 46 of that support 42 into the ground. Preferably, one alternates between driving the one support 42 into the ground and driving the other support 42 into the ground until the lower portions 46 of both supports 42 are buried up to the horizontal members 50.

The support or supports 42 is/are sufficient to secure the sign in place in the ground. Ground stakes 130 may also be used where the stakes 130 have heads 132 which engage the horizontal members 50 of the support 42. The lower portion 46 of the supports 42 located in the ground are removed from the ground by grasping the sign with both hands and pulling upwardly.

Those skilled in the art will appreciate that the sheet or sheets 82, 94 can be readily removed and new or different sheets 82 located in their place while the sign is still in the ground.

Additionally, a cover 100, as described above and as shown in FIG. 5, may be located over the core 20 to convey new and/or different information. The hook and loop fasteners 118, 120 located near the bottom edge 116 of the cover 100 can be engaged with one another to secure the cover 100 to the core 20, as shown in FIG. 7. Additionally, as depicted in FIG. 8, one or more locking strips 124 are located through the apertures 126 in the bottom edge 116 and secured to the support 42 to keep the cover 100 in place.

To replace the cover 100, the locking strips 124 are cut and the hook and loop fasteners 118, 120 are disengaged from one another. The cover 100 can then be manually lifted off of the core 20 and another cover 100 can be located in its place.

Those skilled in the art will also appreciate that if the embodiment of the invention comprising only the core 20, the support 42 and the cover 100 is to be used, the installation of the sign requires fewer steps. In the preferred embodiment of this method, a kit containing the core 20, the support 42 and the cover 100 is provided to the customer. Preferably, the core 100 is converted from a folded core to a planar core, as described above, and the clamp 53 is installed along the upper edge 32. One or more upper portions 44 of one or more supports 42 are installed into the channels 30 of the core 20. The lower portions 46 of the supports 42 are installed into the ground as detailed above. A cover 100, having pigment containing material 84 thereon, is located over the core 100 and secured thereto as described above.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A method of making a sign, comprising:

providing a core with a plurality of channels in an interior portion of said core;

locating one end of at least one support into one of said channels of said core to secure said support to said core;

locating at least one clamp on a top edge of said core; and locating at least one rod through one of said plurality of channels of said core and through said clamp to secure said clamp to said top edge;

wherein said core comprises a first wall and a second wall and one of said walls has a cut and the other wall adjacent said cut functions as a hinge to allow said core to be folded;

wherein said at least one support is comprised of two vertical members and two horizontal members wherein one of said horizontal members is secured to an upper portion of both of said vertical members to allow only a predetermined section of said vertical members to be located in said core and one of said horizontal members is secured to a lower portion of both of said vertical members to allow only a predetermined section of said vertical members to be inserted into the ground;

wherein said at least one rod has a curvilinear end for engaging said clamp and holding said clamp to said core and said rod has a threaded end for receiving a fastener having a complementary set of threads, said fastener for selectively securing said rod in said core;

locating a flexible cover, having a closed top and closed side edges and an open bottom, over said core.

2. The method of claim 1, wherein a portion of at least one sheet is removably located between said core and said clamp.

3. The method of claim 2, wherein a mechanical fastener is located through an aperture in said at least one sheet, said core and said clamp to secure said sheet to said core.

4. The method of claim 3, wherein a first side clamp and a second side clamp secure said at least one sheet to said core.

5. The method of claim 4, wherein at least one ground anchor is manually attached to said support and driven into the ground to secure said support to a portion of ground.

6. The method of claim 5, wherein said cover is secured to said support by at least one locking strip.

* * * * *